US006283453B1

(12) United States Patent
Berget

(10) Patent No.: US 6,283,453 B1
(45) Date of Patent: Sep. 4, 2001

(54) DOUBLE MOORING BOLLARD

(75) Inventor: John Arve Berget, Sylte (NO)

(73) Assignee: Hydralift Marine AS, Dvergsnes (NO)

( * ) Notice: Subject to any disclaimer, the term of this patent is extended or adjusted under 35 U.S.C. 154(b) by 0 days.

(21) Appl. No.: 09/424,007

(22) PCT Filed: May 26, 1998

(86) PCT No.: PCT/NO98/00155

§ 371 Date: Jan. 11, 2000

§ 102(e) Date: Jan. 11, 2000

(87) PCT Pub. No.: WO98/54050

PCT Pub. Date: Dec. 3, 1998

(30) Foreign Application Priority Data

May 26, 1997 (NO) ..... 972389

(51) Int. Cl.[7] ..... B66D 1/26

(52) U.S. Cl. ..... 254/278; 254/295; 114/230

(58) Field of Search ..... 254/278, 290, 254/292, 293, 294, 295, 362; 114/230.1

(56) References Cited

U.S. PATENT DOCUMENTS

| | | | | |
|---|---|---|---|---|
| 1,749,060 | * | 3/1930 | Beaumont | 254/295 |
| 1,950,057 | * | 3/1934 | Lange | 254/290 |
| 3,507,477 | | 4/1970 | Sandoy . | |
| 4,155,539 | | 5/1979 | Alexander et al. . | |
| 5,984,586 | * | 11/1999 | Wudtke | 254/278 |

FOREIGN PATENT DOCUMENTS

| | | | | |
|---|---|---|---|---|
| 386247 | * | 5/1924 | (DE) | 254/362 |
| 1506738 | | 8/1969 | (DE) . | |
| 2102728 | | 7/1971 | (DE) . | |
| 2416415 | | 11/1974 | (DE) . | |
| 2822840 | | 11/1979 | (DE) . | |
| 3138034 | * | 4/1983 | (DE) | 254/278 |
| 211556 | * | 2/1987 | (EP) | 254/294 |
| 474272 | * | 2/1915 | (FR) | 254/362 |
| 464416 | * | 4/1937 | (GB) | 254/295 |
| 1282694 | | 7/1972 | (GB) . | |
| 58221791 | | 12/1983 | (JP) . | |
| 8200133 | | 1/1982 | (WO) . | |

OTHER PUBLICATIONS

Patent Abstracts of Japen of JP 58221791 dated Dec. 23, 1983.

English Translation of claims of DE 2822840 dated Nov. 29, 1979.

English Translation of claims of DE 2416415 dated Nov. 7, 1974.

* cited by examiner

*Primary Examiner*—Emmanuel M. Marcelo
(74) *Attorney, Agent, or Firm*—Ladas & Parry

(57) ABSTRACT

A double mooring bollard fo the contra rotating, mechanically driven type is provided for ship and offshore installations. The mooring bollard includes first and second fixed mooring bollards, at least one of which includes a motor and a centrally located driving axle thereinside. An outer cylinder is rotably provided on the outside of each fixed bollard with an upper end therof arranged for coupling to the driving axle.

9 Claims, 8 Drawing Sheets

DOUBLE MOORING BOLLARD

The present invention is concerned with a mooring bollard, preferably a double mooring bollard of the contra rotating, mechanically driver type, preferably intended for ship and offshore installations for mooring or coiling of a rope.

Rotating bollards are known. Reference is made in this conection to the existing art wherein a rotobollard such as a Pusnes rotobollard is known. This is not, however, motorized as it is placed in connection with a winch. It is further known to put power on the bollard and the hawser directly to the storing reel. Motorizing a bollard is thus not in itself a new idea.

In Norwegian patent application no. 78.0223 a pulling unit including two sets of yardarms is proposed. This is quite a comprehensive piece of equipment that cannot easily be combined to normal standard mooring bollards.

The same may be said in connection with German patent publications DE 2.102.728 C2 and DE 2.416.415.

The novel part of this invention is how a standard-like fixed mooring bollard is provided to also function as if it were motorized and contra rotating.

This is achieved according to the invention with a double mooring bollard (1) of the contra rotating, mechanically driven type, preferably intended for ship and offshore installations, characterised by consisting of:

fixed first and second mooring bollards, a motor arranged internally in at least one of the mooring bollards and with a drive shaft centrally provided in at least one of the bollards, outer cylinders rotatably arranged on the outside of the first and second mooring bollards and with upper end adapted for coupling to the drive shaft.

Other embodiments of this invention are outlined further in the claims.

The present invention will be explained further by means of embodiments of the invention and with reference to the enclosed drawings.

Figure 1:
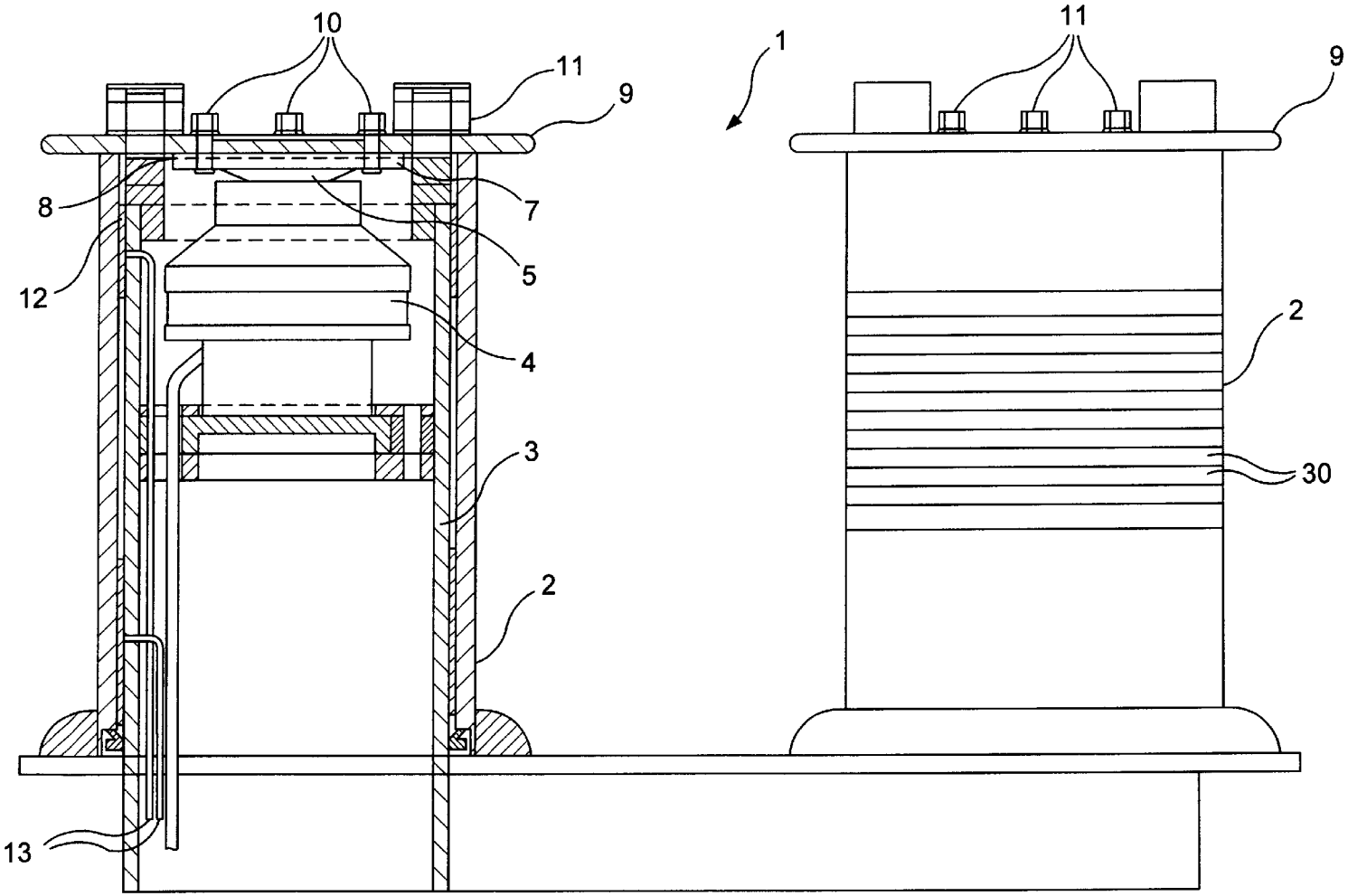
FIG. 1 shows a first embodiment with a motor in both bollards.

With reference to the drawings and firstly to FIG. 1, the details in the invention will be explained further. The figure shows a double mooring bollard 1 without the top lid where two outer cylinders 2 with lids are arranged on the outside of fixed bollards 3, so that the fixed bollards form axle columns with original strength for the now rotating cylinders.

Inside in preferably both the fixed bollards 3 is a motor 4 (electric, hydraulic, etc.) with flexible bearings sideways and with a vertical drive shaft 5 pointing upwards and in the centre of the bollard's inside diameter. The rotation speed is adjusted with gears 6 during operation when run electrically, alternatively oil current/volume during opeation when run hydraulically.

A flange is provided at the axle's top end and is coupled together with a lid 9 through a flexible coupling 7, 8 consisting of a lower coupling section 7 and an upper coupling section 8. When the cylinders are treadedl down over the fixed bollards, the coupling will work.

Bolt(s) 10 through the top lids 9 and preferably threaded together with the coupling's lower section 7 prevents gliding up.

A stopper 11 for one-way rotation is provided inside preferably in connection with the cylinder lid's under and inner side of the fixed bollards 3.

Inside between fixed bollards e and the outer cylinders 2 is provided preferably a sliding bearing 12. Further a sufficient number of grease nipples 13 with pipes is provided.

Figure 2:
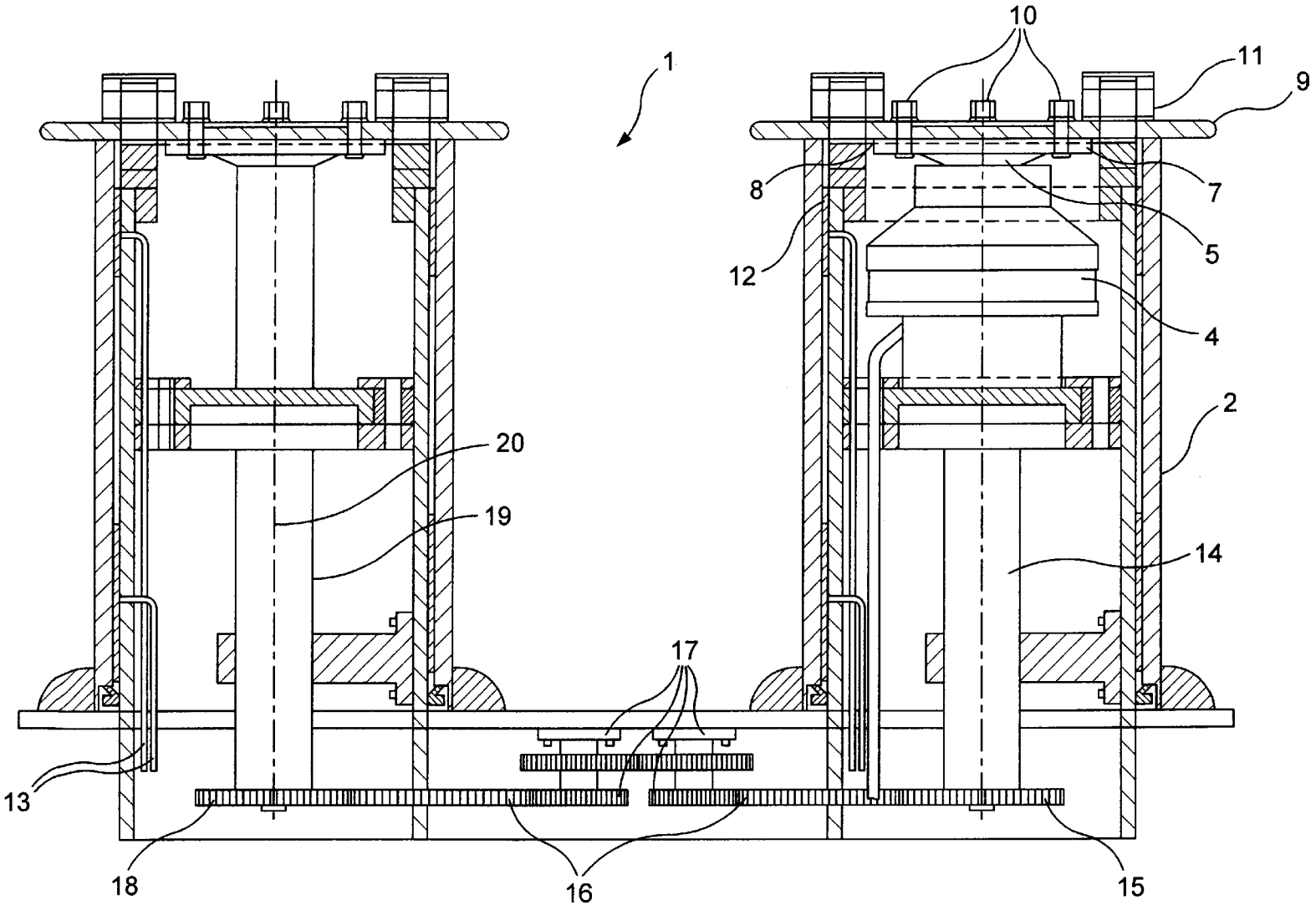
FIG. 2 shows a second embodiment with a motor in one bollard and preferably chain transmission through cogwheels or hawser transmission to the other bollard dimensioned for equal, but contra rotation.
Figure 3:
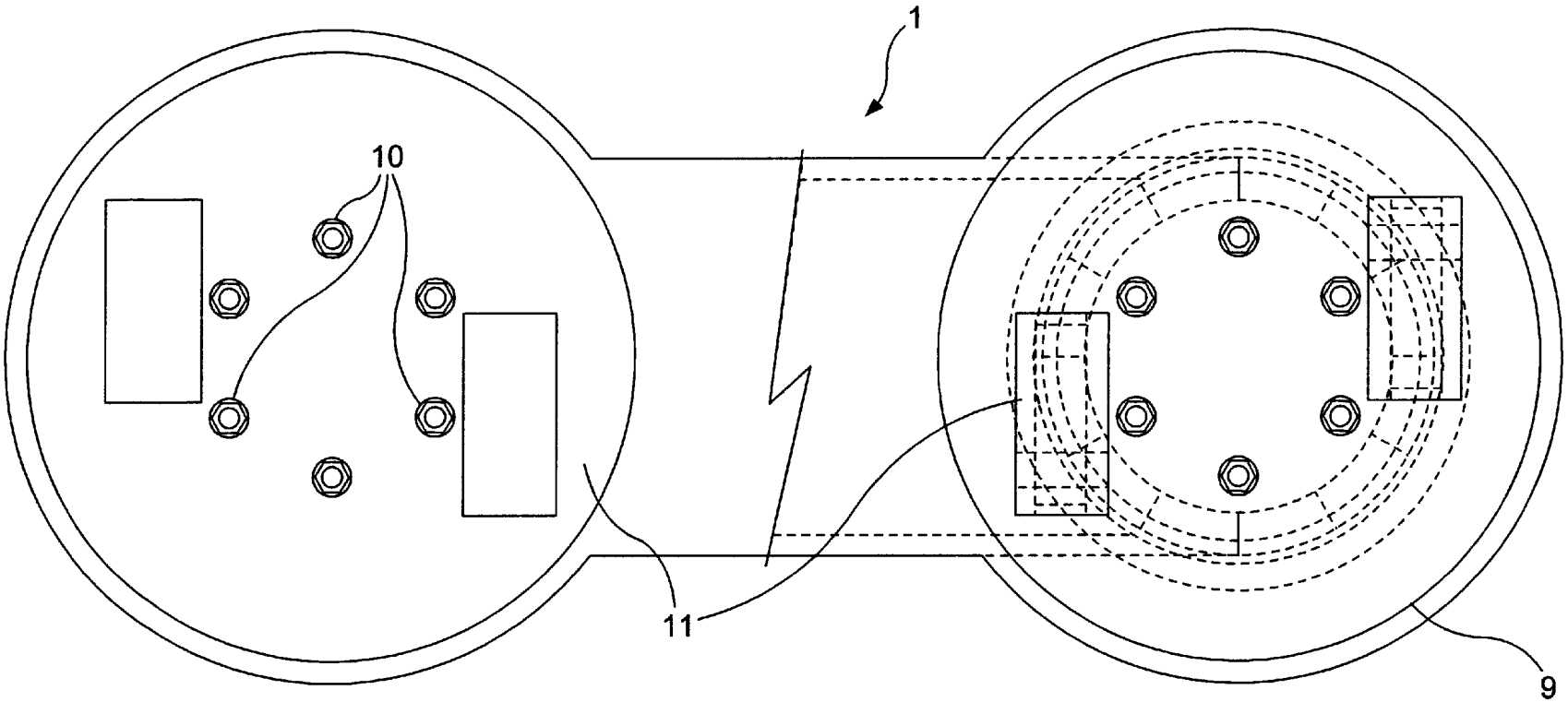
FIG. 3 shows the mooring bollard in FIGS. 1 and 2, seen from above.
Figure 4:
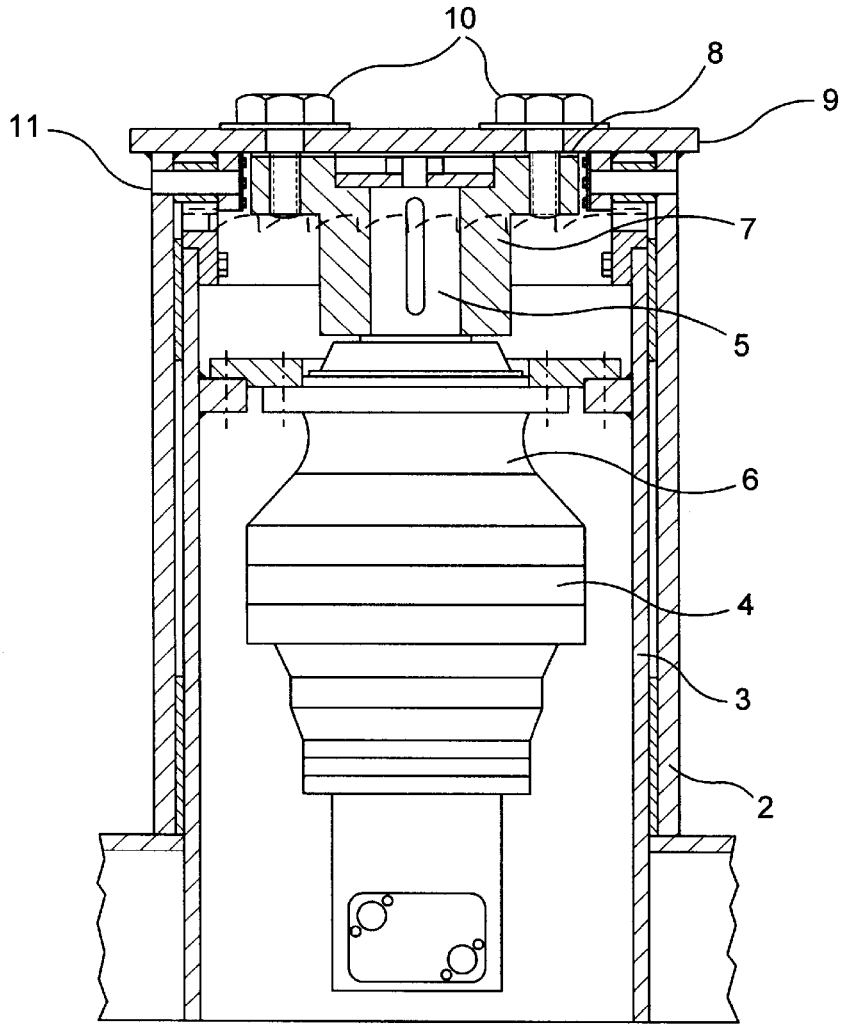
FIG. 4 shows an embodiment with a driving unit with bearings built into the gear, and flexible material around the bolts through the top lid.
Figure 4A:
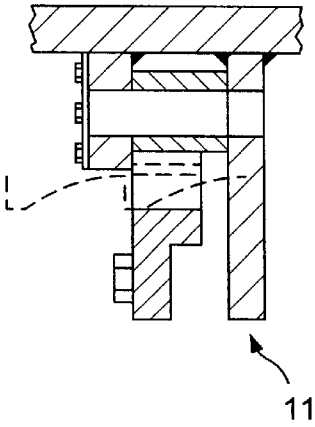
Figure 4B:
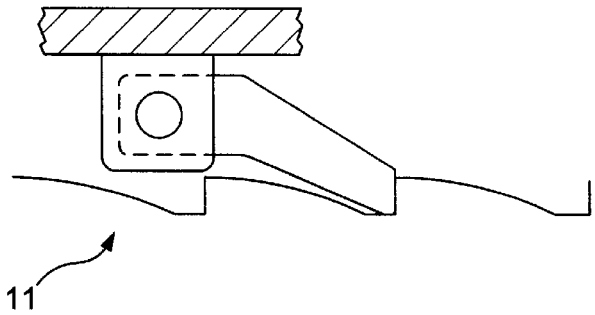
Figure 5:
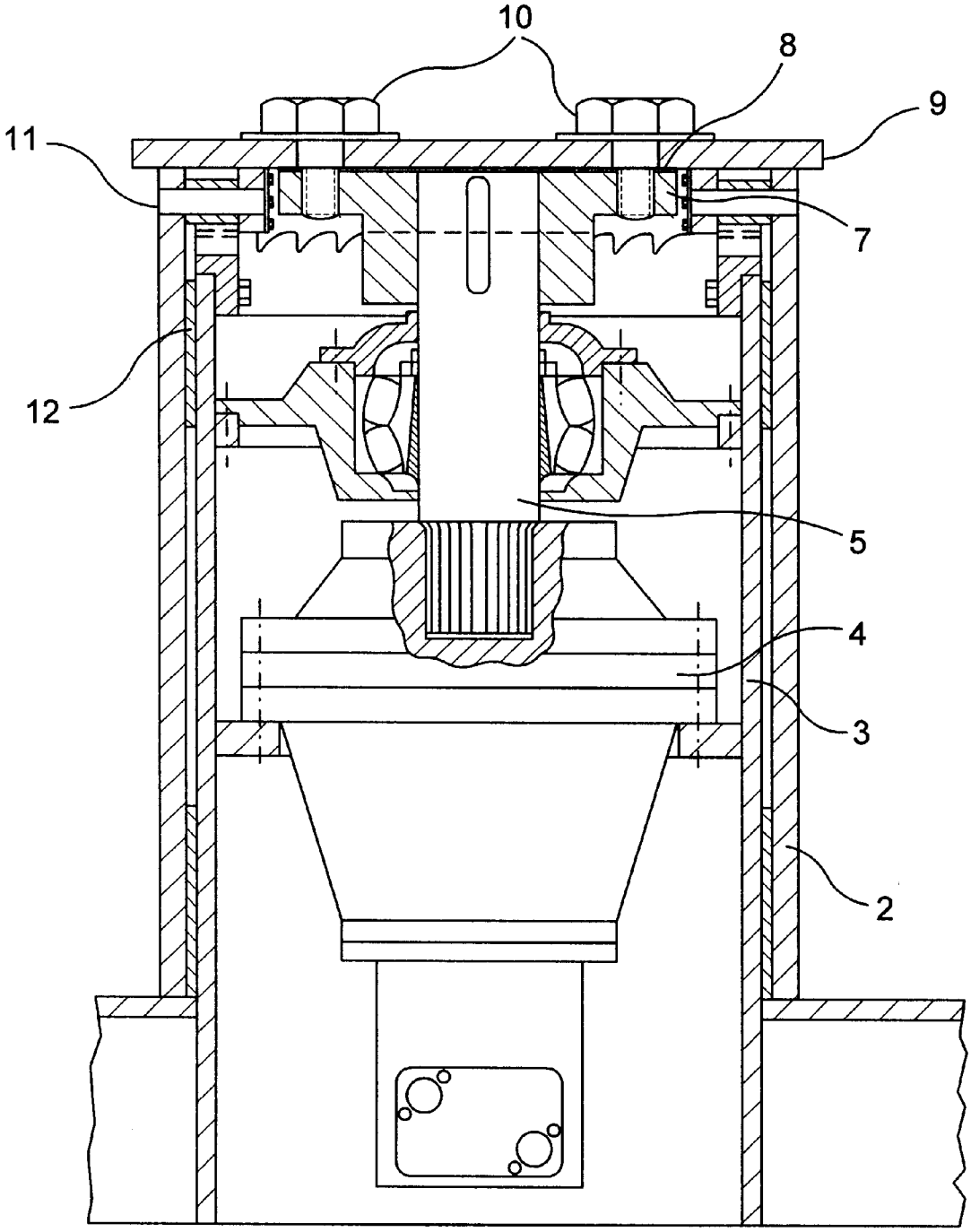
FIG. 5 shows an embodiment with separate bearings for the driving unit.
Figure 6:
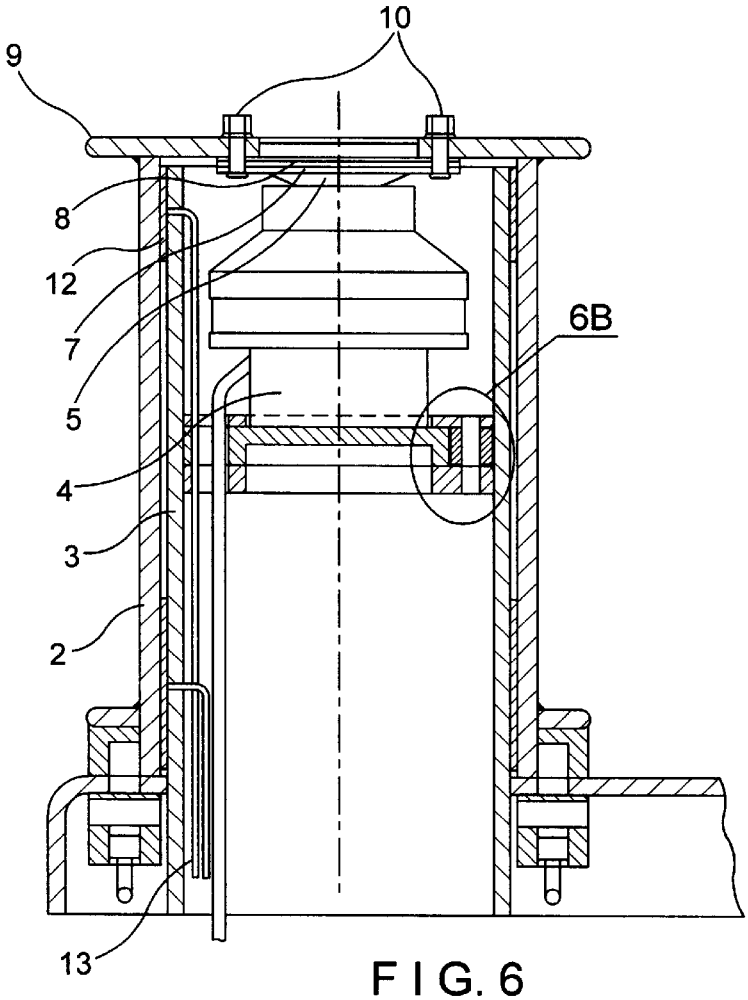
FIG. 6 shows an embodiment with directly coupled motor and stopper in connection with the outer cylinder/inner side foundation.
Figure 6B:
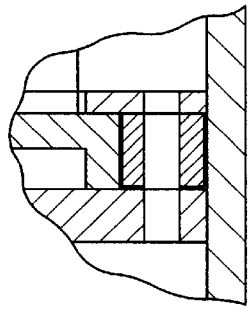
Figure 6A:
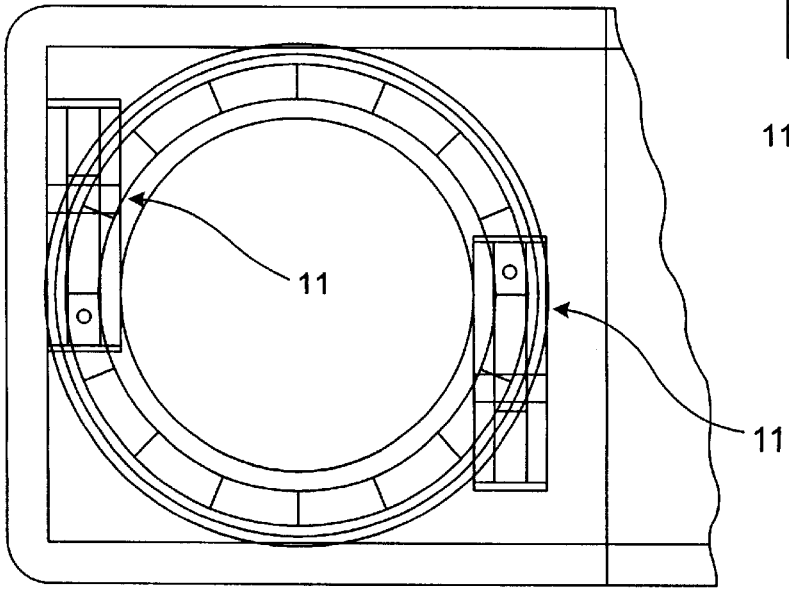
Figure 6C:
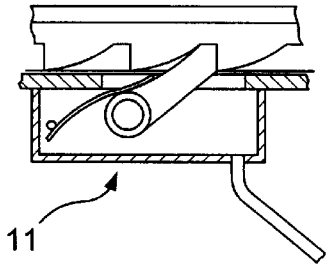
Figure 7:
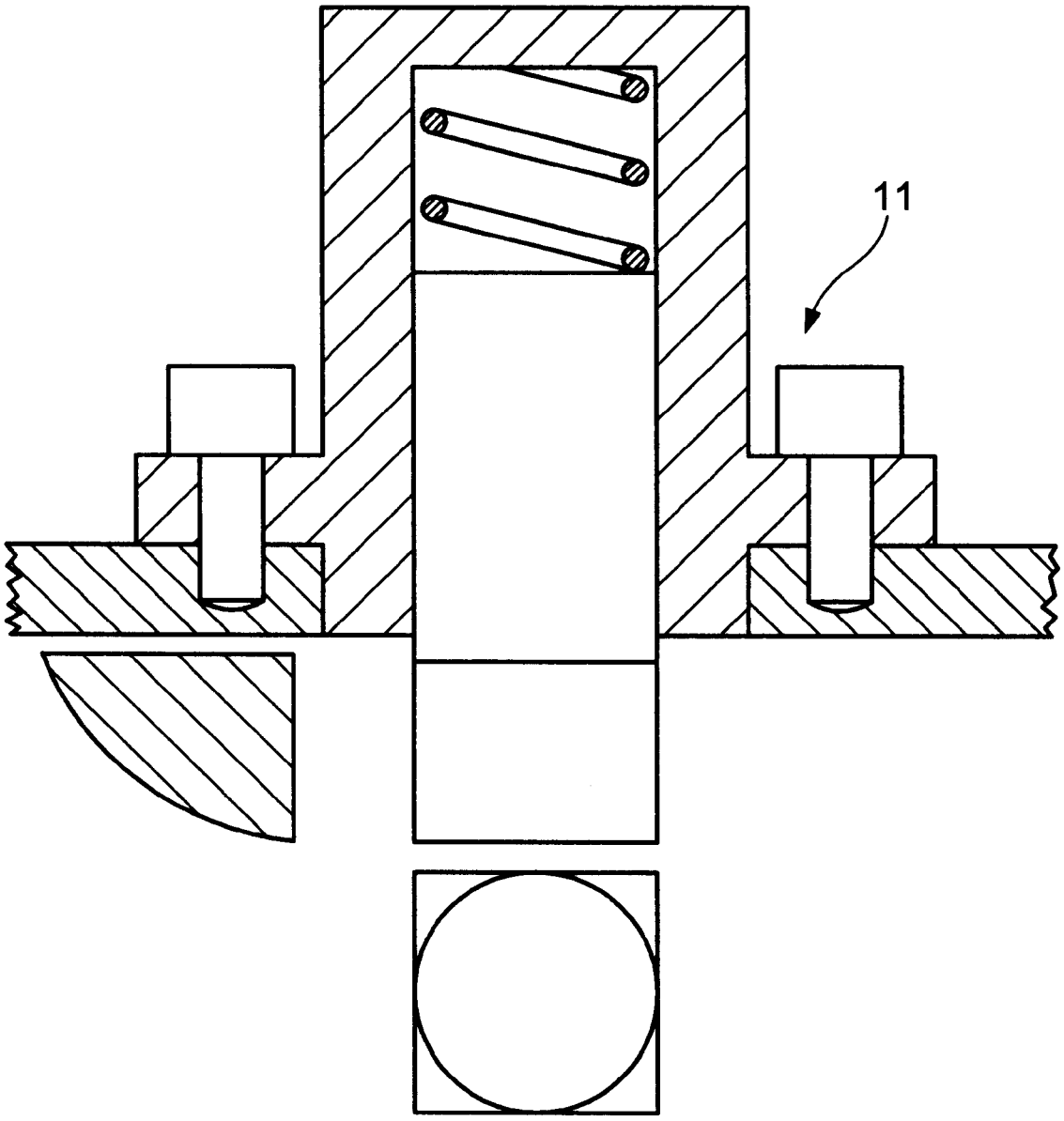
FIG. 7 shows a stopper based on a spring-held bolt.
Figure 8:
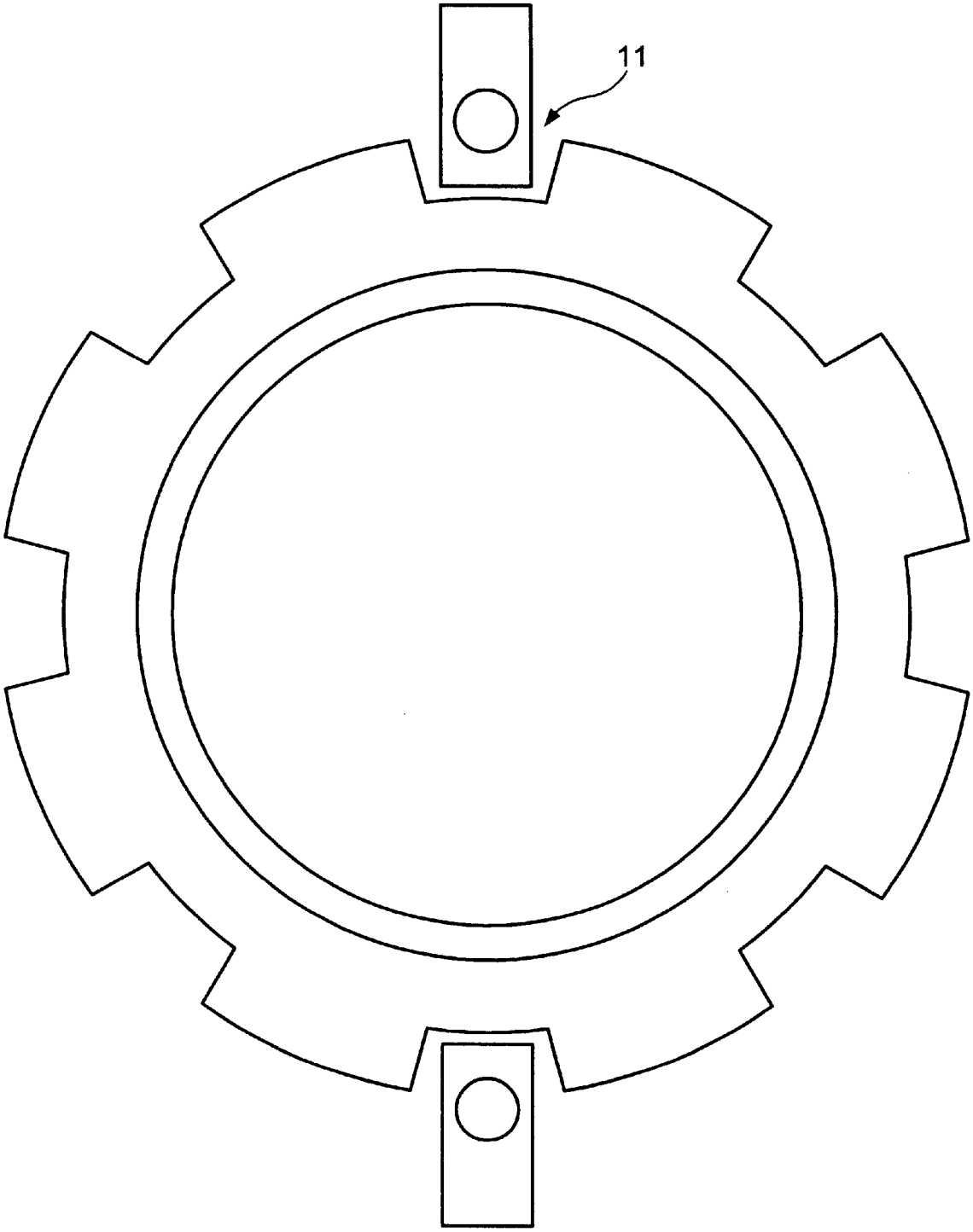
FIG. 8 shows a stopper device based on hydraulic pins that move in/out of a cog crown provided on the outer cylinder.

In another embodiment of the invention, see FIG. 2, the motor 4 is provided in only one of the bollards. The motor 4 has in addition a vertical drive shaft 14 pointing downwards with horizontally fixed cogwheels 15 at the end. By use of preferably chain transmission/hawser 16 through cogwheels 17, 18 horizontally provided in the bollard basis, will force from the bollard with the internal motor be transfereed to an axle 19 held in the centre 20 inside the second bollard 3, such that both cylinders 2 rotate with equal speed, but in opposite directions.

Conventional motorized bollards such as the Pusnes rotobollard suggest to run the bollard and hawser directly to a storing drum. It is furthermore not previously known that motor(s) can be used for running cylinders inside the mooring bollards. The mooring bollard according to the presenyt invention offers maximum compactness, such that the requirements for space on deck and further the bollard construction itself remain nearly identical with ordinary fixed bollards. The bollard according to this invention provides new functions such as tightening or hauling in of a hawser, without the use of a winch. This is also significant since one can avoid using more large mooring winches and purchasing and maintenance costs these would incur. In light of the above the invention offers a simplified and cost-beneficial construction that can be applied on existing ships, platforms, etc. and also in future constructions. This will in turn lead to the following:

Mooring by use of "yardarm" and "Stopper" will become history.

This results in increased safety.

Reduced personnel requirements during mooring, hauling and departure.

Reduced time in port.

Several larger, fixed mooring winches and associated problems of jamming of the hawser on the reel can be avoided.

The double mooring bollard in accordance with the present invention can be producerd, for example, in a workshop, transported to the ship, platform etc. and fixed in place.

The invention also permits existing mooring bollards to be modified, so that they can be run mechanically. Such a modification will include the following: The top lid will be removed and two cylinders with a top lid lowered down over the fixed bollards, in such a way that the fixed bollards form axle columns with their original strength for the now also rotating cylinders. Inside in preferably both the fixed bollards an electric, hydraulic, air etc. motor is provided with a vertical axle pointing upwards from these and in the centre of the bollards' inside diameter. The speed of rotation is adjusted by gears etc., and the direction is set to be opposite for the two cylinders. One part of a preferably flexible coupling is provided on the axle's top end. The associated part is fixed centrally on the cylinder lids' under side. The coupling will take place when the cylinders, which have a greater inside diameter than the fixed bollard's outer diameter, are lowered down. A bolt going through the top lids and preferably threaded together with the coupling's lower half, will keep the parts together and prevent sliding up. When starting the internal motors, the cylinders will rotate around the fixed bollards in such a way that when a hawser is put over the cylinders in a figure-eight, it may be tightened or hauled up. It is the two cylinders that are motorised and contra rotating, not the bollards. A stopper preferably for one-way rotation is provided in connection with the rotating cylinder lids' under side and inside of the fixed bollards.

The bollards in accordance with the present invention may be angular in relation to their base, and grooves (30) for a hawser may also be provided in the outer cylinders (2) of the bollards (as shown in FIG. 1).

A further development of the bollards in accordance with this invention may be, for example, that the hydraulics are built in such a way that the bollards have a tension function, that is keeping the hawser's tension constant, independent of, for example, the ship's movements.

What is claimed is:

1. A contra rotating, mechanically driven double mooring bollard for ship and offshore installations, comprising:

fixed first and second internal mooring bollards;

a motor centrally arranged inside each of the internal mooring bollards; and outer cylinders including a lid rotatably provided on the outside of the first and second internal mooring bollards;

wherein the motor is connected to the lid for contra rotating the outer cylinders.

2. A double mooring bollard according to claim 1, wherein the lid is further provided with bolt holes for receiving a driving axle coupling having a first half and a second half.

3. A double mooring bollard according to claim 2, wherein the motor has an output end provided with the first half of the driving axle coupling and the second half is, via bolts through the cylinder lid, centrally arranged to an underside of the cylinder lid and to the first coupling half.

4. A double mooring bollard according to claim 1, wherein the motor is stored on a flexible base ring that is provided on an inner side of the bollard, in that the motor has bolt holes provided with rubber washers.

5. A double mooring bollard according to claim 1, wherein at least one vertical stopper is provided between an upper end of the cylinder and an inner side of the fixed bollard for one-way and contra rotating of the mooring bollard.

6. A double mooring bollard according to claim 1, wherein a suitable number of sliding bearings including grease nipples with pipes are provided between a top rim of the fixed bollards and an upper end of the cylinder.

7. A double mooring bollard according to claim 1, wherein a suitable number of sliding bearings with grease nipples and pipes are provided between the fixed bollards and the outer cylinders.

8. A double mooring bollard according to claim 1, wherein a stopper is provided between a lower outer wall of each cylinder and an underside of a bollard foundation for one-way and contra rotating of the mooring bollard.

9. A double mooring bollard according to claim 1, wherein outer surfaces of the outer cylinders are provided with grooves for a hawser.

* * * * *